US007172360B2

(12) United States Patent
McSweeney et al.

(10) Patent No.: US 7,172,360 B2
(45) Date of Patent: Feb. 6, 2007

(54) ART INSTRUMENT

(75) Inventors: Anne M. McSweeney, Columbus, OH (US); Michael J. Schumacher, Hilliard, OH (US)

(73) Assignee: Elmer's Products, Inc., Columbus, OH (US)

( * ) Notice: Subject to any disclaimer, the term of this patent is extended or adjusted under 35 U.S.C. 154(b) by 0 days.

(21) Appl. No.: 11/278,846

(22) Filed: Apr. 6, 2006

(65) Prior Publication Data

US 2006/0228163 A1 Oct. 12, 2006

Related U.S. Application Data

(60) Provisional application No. 60/668,667, filed on Apr. 6, 2005.

(51) Int. Cl.
*A46B 11/04* (2006.01)
*B43M 11/06* (2006.01)

(52) U.S. Cl. ..... 401/270; 401/183; 401/186

(58) Field of Classification Search ..... 401/198, 401/199, 270, 271, 274, 276, 278, 282, 183–186
See application file for complete search history.

(56) References Cited

U.S. PATENT DOCUMENTS

| | | | | |
|---|---|---|---|---|
| 677,851 | A | | 7/1901 | Booth |
| 905,986 | A | | 12/1908 | Cole |
| 1,006,641 | A | | 10/1911 | Fesler |
| 1,047,878 | A | | 12/1912 | Avery |
| 1,321,907 | A | | 11/1919 | Graham |
| 1,681,836 | A | | 8/1928 | Boka |
| 1,725,464 | A | | 8/1929 | Lyons |
| 2,236,030 | A | | 3/1941 | Hall |
| 2,272,641 | A | | 2/1942 | Mureau |
| 2,422,823 | A | | 6/1947 | Christensen |
| 2,782,438 | A | | 2/1957 | Wittnebert et al. |
| 2,860,359 | A | | 11/1958 | James |
| 2,932,046 | A | | 4/1960 | Skolnikoff |
| 3,029,464 | A | | 4/1962 | Springmeier |
| 3,300,808 | A | | 1/1967 | Karl |
| 3,372,975 | A | | 3/1968 | Johnson |
| 3,698,770 | A | | 10/1972 | Landen et al. |
| D230,570 | S | | 3/1974 | Hall |
| 4,279,527 | A | | 7/1981 | Moe et al. |
| 4,447,169 | A | | 5/1984 | Vartoughian |
| 4,748,990 | A | * | 6/1988 | Brown et al. ..... 132/320 |
| 4,795,218 | A | | 1/1989 | Seidler |
| 4,826,339 | A | | 5/1989 | Sasaki |
| 4,838,723 | A | * | 6/1989 | Suzuki et al. ..... 401/199 |
| 4,881,289 | A | | 11/1989 | Tsuyoshi et al. |
| 4,902,152 | A | * | 2/1990 | Seidler ..... 401/117 |

(Continued)

*Primary Examiner*—David J. Walczak
(74) *Attorney, Agent, or Firm*—McNees, Wallace & Nurick LLC

(57) ABSTRACT

Art instruments having a self-contained reservoir for dispensing paint or ink to a paintbrush portion provided on one end of the instrument. The instrument includes an ink-dispensing assembly comprised of a series of capillary tubes, orifice restrictors, pins and plugs to provide an assembly that prevents distribution of ink during shipping, but can be easily activated by a user to produce controllable and reliable ink flow to the brush portion on demand. The invention provides differing valve body components and configurations to provide optimal ink flow for inks of differing viscosities, creating a self-wicking art instrument that resists leakage, splattering, and other undesirable characteristics of known self-contained ink art instruments.

20 Claims, 7 Drawing Sheets

U.S. PATENT DOCUMENTS

| | | | |
|---|---|---|---|
| 4,907,841 | A | 3/1990 | Kay et al. |
| 4,908,902 | A | 3/1990 | McNab et al. |
| 4,930,922 | A | 6/1990 | LaRosa et al. |
| 4,968,103 | A | 11/1990 | McNab et al. |
| 4,974,908 | A | 12/1990 | Theodore |
| 4,990,016 | A | 2/1991 | Seidler |
| 5,066,157 | A | 11/1991 | Liff |
| 5,197,496 | A | 3/1993 | Nakamura |
| 5,294,207 | A | 3/1994 | Keating et al. |
| D366,151 | S | 1/1996 | Norris |
| 5,716,104 | A | 2/1998 | Keating et al. |
| 6,413,001 | B1 * | 7/2002 | Kaufmann ..... 401/198 |
| 6,450,724 | B1 | 9/2002 | Cambio |

* cited by examiner

ART INSTRUMENT

CROSS-REFERENCE TO RELATED APPLICATIONS

The present invention is related to U.S. Provisional Patent Application Ser. No. 60/668,667, filed Apr. 6, 2005, to which priority is hereby claimed, and which application is hereby incorporated by reference as though fully set forth herein.

FIELD OF THE INVENTION

The present invention is directed to art instruments, and more particularly to art instruments having a self-contained reservoir for dispensing paint or ink to a paintbrush portion provided on one end of the instrument.

BACKGROUND OF THE INVENTION

Known art instruments include instruments having an internal reservoir portion for holding water, colored inks, paints, and other liquid art media (hereinafter collectively "ink") and a brush portion connected to the reservoir portion for permitting the water or ink to pass through the brush portion for deposit on a desired surface to be painted. For example, U.S. Pat. No. 6,536,969 to Nishitani (assigned to Kuretake Co. Ltd) (the '969 patent) discloses an artist's instrument having a movable body and spring apparatus for controlling flow of ink out of a self-contained reservoir.

Another commercially available ink-dispensing brush is the Art-Kure Watercolour System Colour Sketch Brush (hereinafter the "Art-Kure brush"). The Art-Kure brush includes a body having an ink reservoir connected to a brush portion by an ink-dispensing assembly. The ink dispensing assembly includes a reservoir body having a closed end and an opposite open end, the open end having means for connecting the reservoir body to a nozzle and brush assembly. The ink-dispensing assembly further comprises an outer capillary tube, an inner capillary tube nested inside the outer capillary tube, an open plug inserted into one end of the outer capillary tube and acting as a travel stop for the inner capillary tube, and a secondary orifice restrictor. The secondary orifice restrictor includes a tube-receiving end having a recessed stepped portion for receiving the unencumbered end of the inner capillary tube and a stepped outer surface having a cross-sectional diameter that permits the tube-receiving end to be inserted into the unencumbered end of the outer capillary tube. The secondary orifice restrictor further includes an axial channel that protrudes along the entire axial length of the restrictor. The axial channel is generally cylindrical, and includes at least one stepped portion for receiving a solid pin having a first large-diameter end and an opposite small-diameter end. The large diameter end is inserted into the channel adjacent the tube-receiving end and is pushed up the channel until it reaches the stepped channel adjacent the opposite end of the secondary orifice restrictor, so that the large-diameter end is nearly flush with the terminal end of the channel adjacent the second end of the secondary orifice restrictor, thereby blocking flow through the secondary orifice restrictor. The small-diameter end of the pin protrudes into the channel provided in the inner capillary tube.

The Art-Kure brush's ink-dispensing assembly further includes a primary orifice restrictor having a protruding tube end, an opposite end, and a channel linking the two ends. The protruding tube end is configured so as to penetrate the axial channel of the secondary orifice restrictor and to displace the large-diameter end of the solid pin upon activation of the ink-dispensing system by a user. Displacing the pin permits ink to flow through the open plug into the outer capillary tube and then into the inner capillary tube, around the solid pin and through the axial channel of the secondary orifice restrictor, and through the axial channel of the primary orifice restrictor. The opposite end of the primary orifice restrictor is disposed in close proximity to a bristle portion, the bristle portion surrounded by a valve body having slotted sidewalls to permit the ink flowing from the primary orifice restrictor primarily around the outer perimeter bristles (versus uniformly through or between all bristles) and through the valve body and outside of the valve body, eventually reaching the tapered end of the brush portion for distribution onto a surface to be painted. The brush portion is nested inside the slotted valve body, and the slotted valve body is held in place by a nozzle threaded onto the threaded end of the reservoir body. The Art-Kure brush further includes a shipping ring that is situated between the threaded nozzle and the body, thereby preventing the full threading of the nozzle portion onto the reservoir body which would otherwise press the primary restrictor against the secondary restrictor to activate the secondary restrictor by compressing the pin to allow flow through the axial chamber of the secondary orifice restrictor. Removal of the shipping ring is accomplished by unscrewing a threaded nozzle and brush portion, removing the shipping ring, and re-tightening the threaded nozzle and brush portion onto the body. Re-tightening in this manner compresses a pin located in the secondary orifice restrictor, thereby opening a central passageway in the restrictor to allow ink to flow from the nested capillary tube system through the central passageway and the pin, and into the valve body and brush portion.

Despite some desirable features, the Art-Kure brush is prone to leaking after activation, whether in use or in storage. Leakage is especially prevalent from the brush end of the threaded nozzle portion, and is exacerbated by Art-Kure's use of thin inks having a viscosity of less than about below about 5 centipoise (cps) in conjunction with the slotted valve body, which allows ink to escape the nozzle body and to leak from any gap between the outer nozzle body and valve body, especially around the protruding bristle end of the nozzle. Additionally, thin ink that returns from outside of the valve body under user pressure travels primarily across the outer perimeter bristles of the bristle assembly, rather than evenly throughout all bristles of the bristle assembly. Moreover, once user pressure on the reservoir is released, the Art-Kure bristle portion does not self-wick to continually draw ink from the reservoir, but rather requires the user to re-apply reservoir pressure. Additionally, the Art-Kure brush allows ink to spurt from the brush under user pressure because the slotted structure of the valve body allows the low-viscosity ink to flow outside of the valve body and spurt from the gap between the outer bristles and the valve body, as well as from the gap between the valve body and the threaded nozzle. Such splattering occurs when a user firmly squeezes the reservoir body because the slotted valve body provides virtually no resistance to ink flow, and the flow is unchecked by the bristle assembly, thereby allowing substantially unimpeded flow in response to user pressure on the body. Furthermore, Art-Kure's inclusion of a very porous, open cell cylindrical sponge around the base of the slotted valve body adjacent the bristle base, in combination with ink below 5 cps, does not effectively control flow or mitigate against splatters resulting from firm squeezing of the body reservoir by a user. Additionally, it is believed that Art-Kure's nested capillary system is not optimized for smooth and consistent flow of ink, and particularly not for inks having viscosities of less than about 5 cps. Furthermore, Art-Kure's brush assembly is not suitable for inks having viscosity of greater than about 10 cps.

Thus, the complex assemblies of the '969 patent, the Art-Kure Brush, and other known artist's instruments fail to provide adequate, reliable control of ink to and through a brush portion as required for desirable, high-quality art projects. Moreover, known art instruments having self-contained fluid reservoirs lack features to render the instrument leak-proof during shipping, yet easy to activate for desirable fluid flow, self-wicking, and optimal controlled distribution onto a desired surface to be painted.

Therefore, what is required is an improved art instrument that provides smooth, even, controllable ink flow for inks of various preselected viscosities, and that is substantially leak-proof both before and after activation by a consumer.

SUMMARY OF THE INVENTION

The present invention provides an art instrument having a self-contained liquid reservoir for storing paint or ink, the reservoir communicably linked to a brush portion by an ink-dispensing assembly. The instrument comprises a reservoir body having a closed end and an opposite open end, the open end having means for connecting the reservoir body to a nozzle and brush assembly. The ink-dispensing assembly further comprises an outer capillary tube, an inner capillary tube nested inside the outer capillary tube, an open plug inserted into one end of the outer capillary tube and acting as a travel stop for the inner capillary tube, and a secondary orifice restrictor. The secondary orifice restrictor includes a tube-receiving end having a recessed stepped portion for receiving the unencumbered end of the inner capillary tube and a stepped outer surface having a cross-sectional diameter that permits the tube-receiving end to be inserted into the unencumbered end of the outer capillary tube. The secondary orifice restrictor further includes an axial channel that protrudes along the entire axial length of the restrictor. The axial channel is generally cylindrical, and includes at least one stepped portion for receiving a pin (whether hollow or solid) having a first large-diameter end and an opposite small-diameter end. The large diameter end is inserted into the channel adjacent the tube-receiving end and is pushed up the channel until it reaches the stepped channel adjacent the opposite end of the secondary orifice restrictor, so that the large-diameter end is nearly flush with the terminal end of the channel adjacent the second end of the secondary orifice restrictor. The opposite small-diameter end of the pin protrudes into, but preferably does not completely obstruct, the channel of the inner capillary tube.

The ink-dispensing assembly further includes a primary orifice restrictor having a protruding tube end, an opposite end, and a channel linking the two ends. The protruding tube end is configured so as to penetrate the axial channel of the secondary orifice restrictor and to displace the large-diameter end of the pin upon activation of the ink-dispensing system by a user. Displacing the pin permits ink to flow through the open plug into the outer capillary tube and inner capillary tube, into the axial channel of the pin, through the axial channel of the secondary orifice restrictor, and through the axial channel of the primary orifice restrictor. Because the opposite end of the primary orifice restrictor is disposed in close proximity to a bristle portion, the ink flowing from the primary orifice restrictor immediately meets the open end of the valve body adjacent the base of the bristle portion. The valve body controls and directs ink flow through and around the bristles to the tapered distal end of the brush portion for distribution onto a surface to be painted. Preferably, the brush portion and valve body are held in place by a nozzle tightly threaded onto the threaded end of the reservoir body.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The present invention is directed to an art instrument in the form of a paintbrush having a self-contained paint reservoir and means for controlling the dispensing of paint from the reservoir to a brush portion for distributing paint to a desired surface to be painted.

Figure 1:
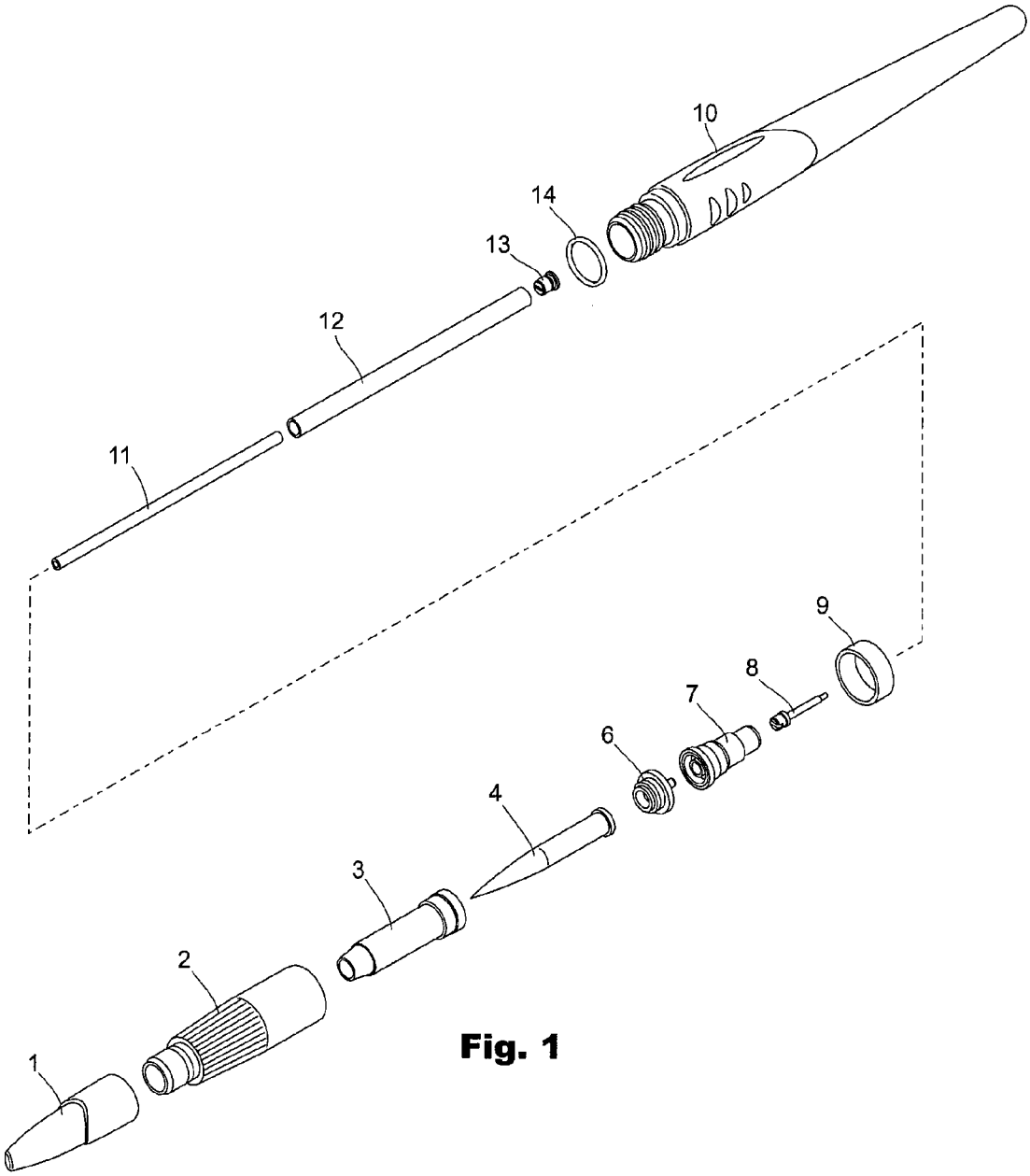
FIG. 1 is an exploded perspective view of the art instrument in accordance with one embodiment of the present invention.
Figure 2A:
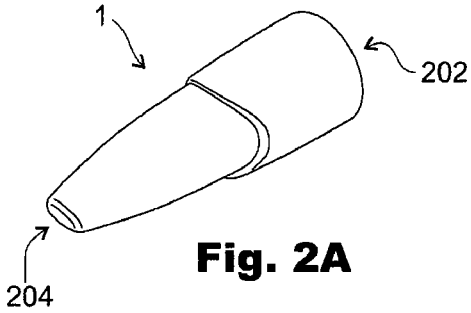
FIGS. 2A through 2D illustrate the cap of the art instrument in accordance with one embodiment of the present invention.
Figure 2B:
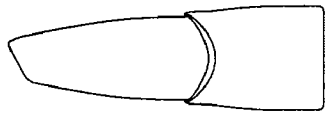
Figure 2C:
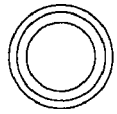
Figure 2D:
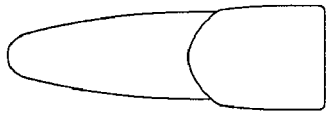

Referring to the drawings, FIG. 1 illustrates an exploded perspective view of the paintbrush of the present invention in accordance with a first embodiment. In this embodiment, the paintbrush is comprised of a plurality of interconnected parts that operate to permit a user to controllably release of ink or paint from the reservoir through the brush portion for dispensing onto a desired surface to be painted. Each component is further detailed in the attached FIGS. 1–13, and is further described in terms of structure and function herein.

As shown in FIG. 1, the first embodiment of the paintbrush includes a cap 1, a nozzle 2, a valve body 3, a bristle portion 4, a primary orifice restrictor 6, a secondary orifice restrictor 7, a pin 8, a shipping ring 9, a reservoir body 10, an inner capillary tube 11, an outer capillary tube 12, and a plug 13. Optionally, the assembly further includes sealing means such as an O-ring 14 disposed between the secondary orifice restrictor 7 and the reservoir body 10, and that preferably approximates the sidewall diameter of the open end 1002 of body 10. Each component is sized so as to securely fit against and/or nest into the adjacent components, as further described herein. The tight fit and interconnection of the components provides a leak-proof assembly that can easily be activated by a user to easily and controllably dispense ink or paint contained in the instrument onto a desired surface to be painted.

As further described herein, the paintbrush is initially activated by a user disassembling the instrument, removing the ring 9, and reassembling the instrument to activate the dispensing components. Thereafter, the instrument is activated by a user exerting pressure on the reservoir body 10, such as by gently squeezing the reservoir body 10. Because of the airtight assembly of the paintbrush, the user-exerted pressure is translated to the liquid ink or liquid paint contained in the reservoir body 10, forcing the liquid through the internal dispensing components to the bristle portion 4, as further described herein.

As illustrated in FIGS. 2A–2D, the cap 1 serves to cover the exposed bristle portion 4 when the paintbrush is not in use. The cap 1 includes an open end portion 202 and an opposite closed end portion 204. The open end portion 202 is sized and shaped so as to form a watertight seal when placed over and pressed against the brush end 302 of the nozzle 2. Preferably, the open end portion 202 and the brush end 302 include a groove and corresponding raised ridge, respectively, to produce a snap-fit closure. Optionally, the cap may be vented, such as by providing pores or slots in the sidewall to permit pressure to escape after activation of the art instrument, such as in storage after activation.

Figure 3A:
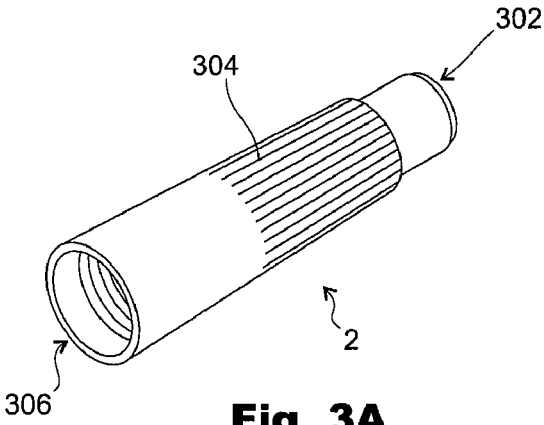
FIGS. 3A through 3C illustrate the nozzle of the art instrument in accordance with one embodiment of the present invention.
Figure 3B:
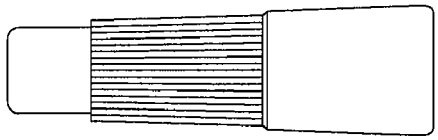
Figure 3C:
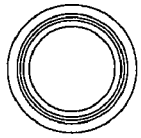

As shown in FIGS. 3A–3C, the nozzle 2 is a hollow, generally cylindrical piece that includes a brush end 302, a body portion 304, and a threaded end 306. As previously described, the brush end 302 is sized and shaped so as to receive the open end 202 of the cap 1. The body portion 304 has an outer diameter that is generally consistent with the outer diameter of cap 1, ring 9 and the reservoir body 10, so that when assembled the cap 1, nozzle 2, ring 9, and reservoir body 10 form a smooth outer surface without raised portions that might otherwise irritate a user. As shown in FIG. 3A, the body portion 304 may optionally include a textured outer surface, rubber coating, or other known grip-enhancing features to assist in providing a user with adequate grip to control the paintbrush even when the user's hands are wet. The threaded end 306 permits the making of a secure and watertight connection of the nozzle 2 to the reservoir body 10.

As shown in FIGS. 4A–4F, the valve body 3 serves to receive and securely retain the bristle portion 4 of the paintbrush. The valve body 3 is generally cylindrical, having a distal end portion 403 with a distal opening 402, a base portion 408 having a base opening 410, and a substantially cylindrical sidewall portion 404 located between the distal end portion 402 and the base portion 408. The valve body 3 further includes a longitudinal central passageway of predetermined diameter that connects the base opening 410 and distal opening 402. The valve body 3 includes outer surface features such as a stepped portion 406 and a reduced neck portion 403 that collectively permit the valve body 3 to securely and frictionally fit inside the nozzle 2, and to securely meet the primary restrictor 6 for a watertight connection adjacent the capped end 502 of the bristle portion 4. The valve body 3 further includes an inner diameter that is compatible with the bristle portion 4 to permit the bristle portion 4 to be inserted into and securely retained by inner surface of the valve body 3. Preferably, the inner surface of the valve body includes retaining means such as a plurality of ridges 412 on the internal surface of at least one portion 406, 408 that securely hold the capped end 502 of the bristle portion 4. Preferably, the ridges are provided at the stepped portion 406 adjacent the body portion 404, thereby allowing the open end 410 to remain open and available to receive the primary orifice restrictor 6, as further described herein.

The primary functions of the valve body 3 are to support the bristle assembly 4, and to direct and regulate ink flow in a controlled fashion. The present invention provides two embodiments of the valve body 3, each embodiment directed to optimal control of ink flow of differing preselected viscosities, but can also be selected based upon the desired application, for example, applications requiring different delivery rates and volumes of ink. The embodiments include a first non-vented sidewall embodiment such as that as shown in FIG. 4A–4C, and a second vented sidewall embodiment shown in FIGS. 4D–4F.

Figure 4A:
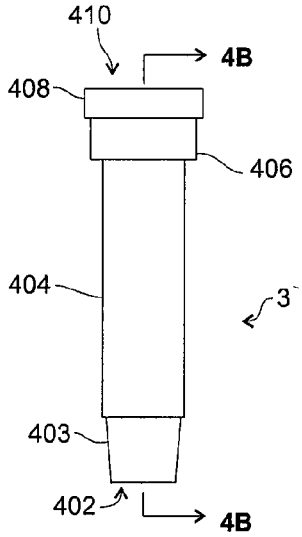
FIGS. 4A through 4C illustrate an unvented, solid wall valve body of the art instrument in accordance with one embodiment of the present invention.
Figure 4B:
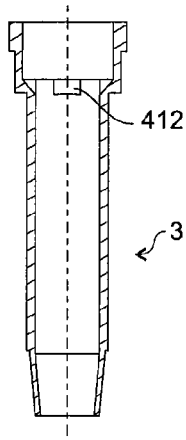
Figure 4C:
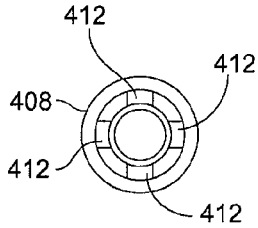

In the first embodiment shown in FIGS. 4A–4C, the valve body 3 includes an unvented and substantially nonporous sidewall 404. This first embodiment is most compatible with inks or paints having a viscosity of less than about 8 cps, more preferably having a viscosity of less than about 6 cps, and most preferably less than about 5 cps.

Figure 4D:
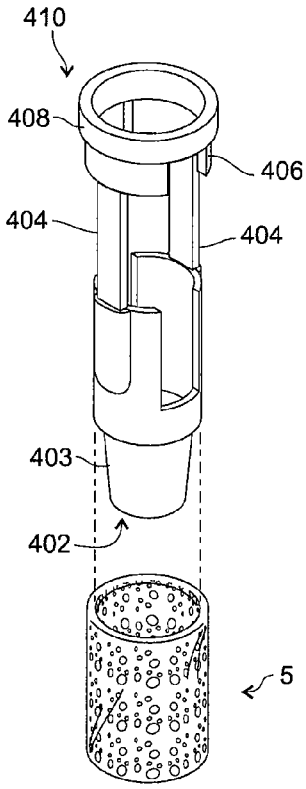
FIGS. 4D through 4F illustrate the vented wall valve body of the art instrument in accordance with one embodiment of the present invention.
Figure 4E:
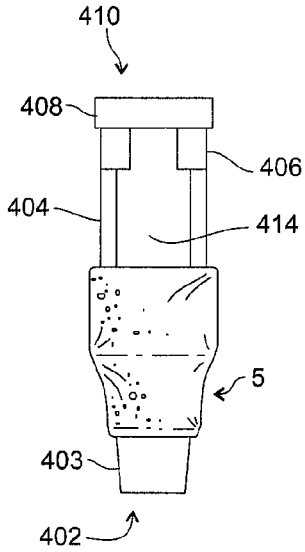
Figure 4F:
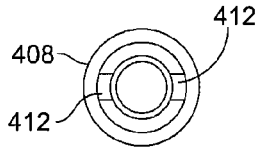

In the second embodiment shown in FIGS. 4D–4F, the valve body 3 includes a vented or substantially porous sidewall. This second embodiment is most compatible with inks having a viscosity of greater than about 5 centipoise (cps), more preferably having a viscosity of greater than about 8 cps, and most preferably having a viscosity greater than about 10 cps.

In the first embodiment of the valve body 3 shown in FIGS. 4A–4C, the valve body 3 includes a substantially non-porous sidewall portion 404, that is, a sidewall with no slots, pores, or other venting connecting the interior of the valve body 3 with the exterior of the sidewall 404 or interior chamber of the nozzle body 2. This embodiment is most suitable when provided in combination with low viscosity ink formulas, that is, inks having a viscosity of less than about 8 cps, more preferably less than about 6 cps, and most preferably less than about 5 cps. The valve body 3 of this first embodiment contains a solid, nonporous sidewall 404 having the features shown in FIGS 4A–4C as shown and as previously described herein. In this first embodiment, the fluid flow of low viscosity ink or paint is from the primary orifice restrictor 6 into the base opening 410, through and around the capped end 502 of the bristle portion 4 and through the bristle body 504 located inside the internal passageway of the valve body 3 and out the end of the valve body 3 to the dispensing distal end 506 of the bristle portion. Testing of this embodiment by the inventors using low viscosity inks, such as inks having a viscosity of less than about 8 cps, showed that the non-vented second embodiment of the valve body 3 provides the most desirable fluid flow, including flow substantially through and between all bristles of the bristle assembly 4. In this embodiment, because the ink flow is contained and directed by the solid sidewall 404 of the valve body 3, flow resistance is provided by the bristle portion 4, allowing controlled flow without spurting, regardless of the amount of user pressure exerted on the reservoir body 10. The second embodiment of the valve body 3 thus allows the lower viscosity inks to flow easily, with great control, and without splattering or leaking.

In the second embodiment shown in FIGS. 4D–4F, the valve body 3 includes a sidewall portion 404 having at least one vent 414 that communicably links the interior passageway of the valve body to the exterior area surrounding the valve body sidewall 404. The vent 414 permits higher-viscosity inks to flow both through the internal passageway of the valve body 3, through and around the bristle assembly located therein, and simultaneously through the vent 414 and around the valve body 3 as bounded by the internal sidewall of the nozzle 2. Because ink is permitted to flow both through and around the valve body 3, the resistance to flow is low. To avoid otherwise uncontrolled flow from the primary and secondary orifice restrictors 6, 7 in this embodiment, the brush optionally further includes a secondary regulator, such as a cylindrical sponge 5, that provides a secondary regulation point for ink or paint flow to effectively reduce or eliminate ink splatter that might otherwise result from a user squeezing the reservoir 10 and from the otherwise relatively unchecked flow through the valve body 3, vent 414, nozzle 2, and bristle assembly 4 and from any gaps therebetween. Preferably, the secondary regulator 5 is provided so as to surround the sidewall 404, preferably positioned adjacent the distal end portion 403. The secondary regulator 5 is preferably made of porous material, such as open cell foam or other sponge material. A benefit of including a secondary regulator in combination with the vented valve body 3 and an ink having viscosity of greater than about 5 cps, preferably greater than about 8 cps, and most preferably greater than about 10 cps, is that it promotes "self-wicking" by allowing the capped end 502 of the bristle portion 4 to remain primed with ink from the sponge 5 without the need for squeezing of the reservoir by the user. Self-wicking thus allows versatile ink flow that can be controlled by a user. The reservoir 10 can be squeezed to dispense a relatively large quantity of ink for blending, or alternatively a user can dispense a relatively small amount of ink by relying on the self-wicking feature and therefore exerting little, or no, squeezing pressure on the reservoir body 10.

Another purpose of the valve body 3 is to provide a housing to position the bristle assembly against the primary orifice restrictor 6. If the bristle assembly is not positioned properly against the primary orifice restrictor then the ink flow will not be directed smoothly to the distal end 506 of the bristle portion 4. For example, experiments using the vented valve bodies of FIGS. 4D–4F confirmed a strong relationship between controllability of ink flow and the size of a gap defined by the difference outside diameter of the bristle assembly 4 and the inside diameter of the valve body 3. Preferably, the difference between the outside diameter of the bristle assembly 4 and the inside diameter of the valve body 3 is less than about 0.5 millimeters, and more preferably is less than about 0.25 millimeters.

As previously described, the vented embodiment of the valve body 3 is most compatible with inks or paints having a viscosity of greater than about 5 cps. In contrast, preferred embodiments of the non-vented valve body 3 utilize inks having a viscosity of less than about 5 cps to provide optimal smooth and controllable ink flow where the body portion 504 adjacent the capped end 502 is tightly bounded by the internal passageway of the valve body 3.

The inclusion of the particular valve body 3 embodiments in combination with the ink viscosities described herein have yielded surprising results and improved performance over known ink-dispensing art brushes. The inventors have found that the use of a vented valve body 3 in combination with lower viscosity inks, such as inks having a viscosity of less than 5 cps, such as in the known Art-Kure brush previously described herein, allow thin ink to flow in an unchecked and uncontrolled manner around and along the peripheral axial edges of the bristle assembly 4, as well as into the nozzle portion 2 where it can leak through the threaded end adjacent the body portion 10 and/or leak out between the nozzle 2 and the valve body 3 adjacent the distal end 403. Thus known ink-dispensing brushes allow low viscosity inks to freely flow out the sides of the bristle and nozzle assemblies, and connections therebetween resulting in an uncontrolled and undirected flow of ink that yields poor control of the ink flow by a user, and further allows ink splatter upon squeezing of the reservoir. The lack of a solid valve body in known brushes also means that thin ink is not directed uniformly through and between the bristles, which keeps the bristles from being uniformly saturated, and also prevents the bristles from otherwise serving as a flow regulator.

Figure 5A:
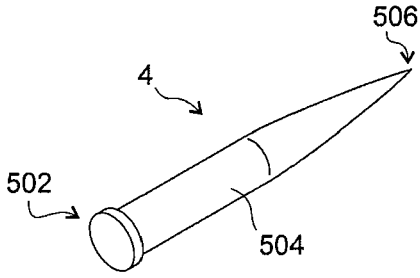
FIGS. 5A through 5Cc illustrate the bristle component of the art instrument in accordance with one embodiment of the present invention.
Figure 5B:
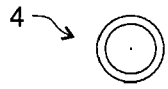
Figure 5C:
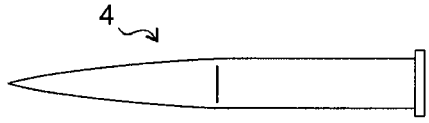

The inventors have further discovered that the proper combination of higher viscosity inks with the vented valve body 3, or lower viscosity inks with the unvented valve body 3, respectively, result in self-wicking once the assembly is initially primed by a user exerting squeezing pressure on the reservoir body 10. As shown in FIGS. 5A–5C, the bristle portion 4 is provided as a generally cone-shaped assembly of bristles secured by a capped end 502. The bristle portion includes a tapered end 506 opposite the capped end 502, the two ends 502, 506 being joined by a body portion 504. The capped end 502 includes a cap member that secures all bristles into a common assembly. The cap member can be porous or non-porous, and may permit ink to flow through and/or around the cap member to reach the bristles in the body portion 504 and tapered end 506. As further described herein, upon initial activation of the assembled art instrument, is the proximity of the capped end to the primary orifice restrictor 6 that permits ink to flow from the restrictor 6 into the bristle portion 4.

Further, the relative diameters of the bristle assembly 4 relative to the inner diameter of the valve body 3 are important to control ink flow, particularly in the unvented embodiment of valve body 3 in combination with thin inks. Preferably, any circumferential gap formed between those two elements is less than about 0.1 to 0.5 millimeters, corresponding to a relative difference in diameter of between about 0.2 to 1.0 millimeters. This relationship is particularly crucial to ease of use of the device, proper ink flow, ink control & splatter when using thin inks of less than about 8 cps. This dimension is also important for proper wicking, and self-wicking, of the ink through the bristles of the bristle assembly 4.

Figure 6A:
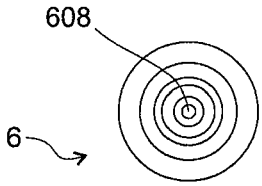
FIGS. 6A through 6B illustrate the primary orifice restrictor of the art instrument in accordance with one embodiment of the present invention.
Figure 6B:
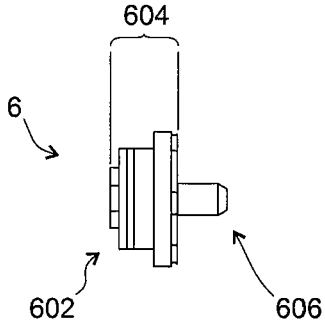

As shown in FIGS. 6A–6B, the primary orifice restrictor 6 is a generally disk-shaped valve having a generally circular first end 602 for connection to the capped end 502 of the bristle portion 4, and an opposite protruding tube end 606 for connection to the secondary orifice restrictor 7. The restrictor 6 includes an axial open-ended channel 608 that connects the first end 602 and the opposite tube end. The channel 608 is preferably generally cylindrical, and is more preferably of uniform diameter. The protruding tube end 606 is configured so as to frictionally fit inside of the axial channel 708 provided in the secondary orifice restrictor 7, as further described herein. The primary orifice restrictor is preferably made from a flexible or semi-flexible material, such as low-density polyethylene (LDPE), for example.

Figure 7A:
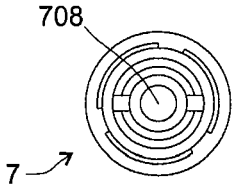
FIGS. 7A through 7B illustrate the secondary orifice restrictor of the art instrument in accordance with one embodiment of the present invention.
Figure 7B:
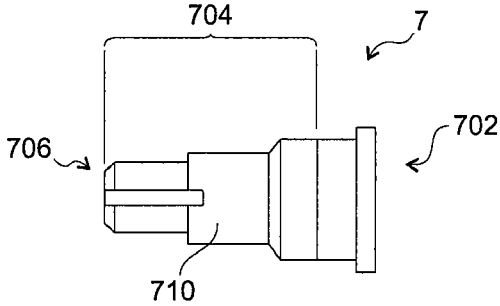

As shown in FIGS. 7A–7B, the secondary orifice restrictor 7 is a generally cylindrical-shaped valve having a generally circular first end 702 sized to mate with the threaded end 1002 of the reservoir body 10 to form a watertight seal. Optionally, the first end 702 of the secondary orifice restrictor 7 is disposed to engage an annular flexible seal 14, such as a rubber o-ring, to form a tight seal between the threaded end 1002 of the reservoir body 10 and the restrictor 7. The first end 702 includes an axial open-ended channel 708 for receiving the protruding tube end 606 of the primary orifice restrictor. The restrictor 7 further includes an opposite pin-receiving end 706 for insertion of the pin 8. The restrictor 7 includes an axial open-ended channel 708 that connects the first end 702 and the pin-receiving end 706. The channel 708 is preferably generally cylindrical, and is more preferably of uniform diameter. The inner diameter of the channel 708 at the first end 702 is greater than the outer diameter of the protruding tube end 606, so as to permit the insertion of the tube end 606 into the channel 708 at the first end 702 and to retain the tube end 606 by friction alone. Similarly, the channel 708 adjacent the pin-receiving end 706 is of sufficient diameter to permit the insertion of the first end 802 of the pin 8 and retention by friction alone. Additionally, restrictor 7 at the pin-receiving end 706 has an outer diameter that is roughly equivalent to the inner diameter of the outer capillary tube 12 so as to permit insertion of the end 706 into the axial channel of the capillary tube 12 and retention thereof by friction alone. The secondary orifice restrictor 7 is preferably made from a flexible or semi-flexible material, such as low-density polyethylene (LDPE), for example.

Figure 8A:
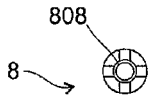
FIGS. 8A through 8B illustrate the pin of the art instrument in accordance with one embodiment of the present invention.
Figure 8B:
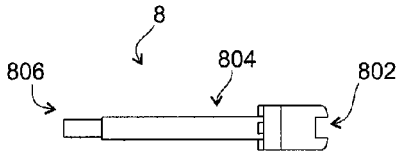

As shown in FIGS. 8A–8B, the pin 8 is a generally cylindrical-shaped tube (which may be hollow or solid) having a generally cylindrical first end 802 for engaging the tube-receiving end 706 of the secondary orifice restrictor 7, as previously described. The pin 8 further includes an opposite protruding end 806 for insertion into the inner capillary tube 11, without entirely obstructing the tube 11. Preferably, the ends 802, 806 are connected by an axial channel 808. More preferably, the pin 8 at the protruding end 806 has an outer diameter that is roughly equivalent to the inner diameter of the inner capillary tube 11 so as to permit insertion of the end 806 into the axial channel of the capillary tube 11 and retention by friction alone. The pin 8 is made from a flexible or semi-flexible material such as low-density polyethylene (LDPE), for example.

Figure 9A:
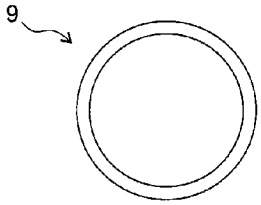
FIGS. 9A through 9B illustrate the ring of the art instrument in accordance with one embodiment of the present invention.
Figure 9B:
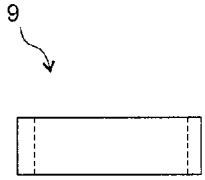

As shown in FIGS. 9A–9B, the paintbrush includes a shipping ring 9. The shipping ring 9 is provided as a spacer between the reservoir body 10 and the nozzle 2, so that upon assembly for shipping the body 10, ring 9 and nozzle 2 form a smooth and continuous outer surface for gripping by a user. Preferably, the shipping ring 9 includes a smooth and substantially circular cross-sectional geometry to allow it to fit over the threaded end 1002 of the reservoir body 10, and an outer circumference that is identical to the outer circumference of the body 10 adjacent the threaded end 1004. The function of the shipping ring 9 is to prevent unintended activation of the internal valve components 6 and 7. Preferably, the ring 9 is of sufficient width so as to allow the nozzle 2 and reservoir to be screwed together, without exerting any pressure to force the primary restrictor 6, and particularly the protruding end 606, against the secondary restrictor 7. Thus, when the ring 9 is in place, the nozzle 2 and reservoir 10 cannot be screwed together closely enough so as to force the protruding end 606 to puncture the axial channel 708 of the orifice restrictor, and to thereby press against the pin to allow a gap to form between the pin end 802 and the pin-receiving end 706 that would permit the flow of ink from the inner capillary tube 11 to the axial channels 708, 608, and to the bristle portion 4. However, when the ring 9 is removed, the nozzle 2 can be threaded onto the threaded end 1002 far enough so that protruding end 606 punctures the axial channel 708 of the orifice restrictor, and presses against the pin 8 to allow a gap to form between the pin end 802 and the pin-receiving end 706, and particularly between the end 802 and the channel step 710, and thereby permits the flow of ink from the inner capillary tube 11 to the axial channels 708, 608, and to the bristle portion 4.

Figure 11A:
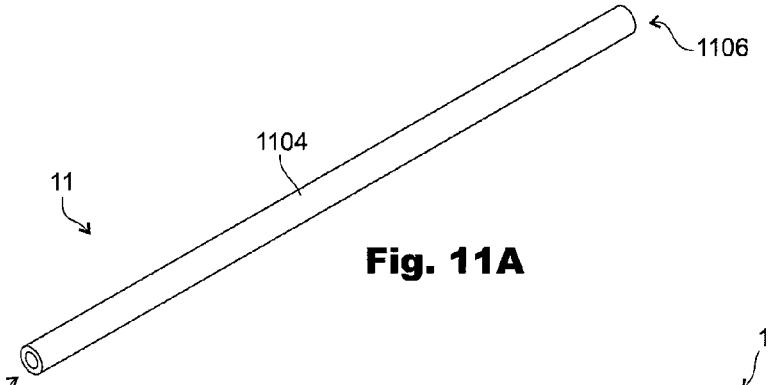
FIGS. 11A through 11B illustrate the inner capillary tube of the art instrument in accordance with one embodiment of the present invention
Figure 11B:
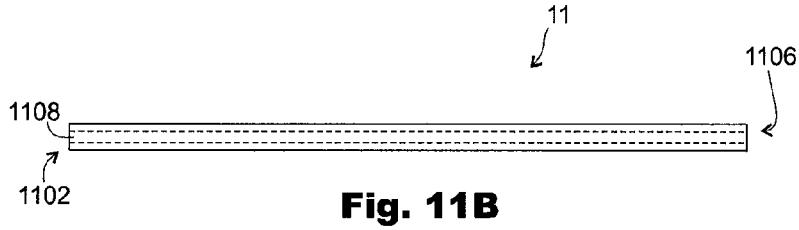

FIGS. 11A–11B illustrate an embodiment of the inner capillary tube 11, wherein the inner capillary tube 11 is essentially generally cylindrical in shape, and includes a axial tube body 1104 joining a first open end 1102 and an opposite open end 1106. The outer diameter of the inner capillary tube 11 is at least slightly less than the inner diameter of the outer capillary tube 12. Preferably, the tube 11 is made from a flexible material such as HDPE, and has a nominal wall thickness of between about 0.01 to 0.03 inches.

Figure 12A:
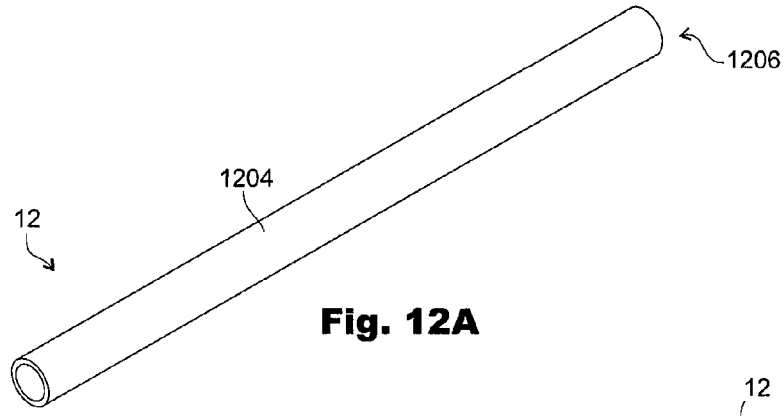
FIGS. 12A through 12B illustrate the outer capillary tube of the art instrument in accordance with one embodiment of the present invention.
Figure 12B:
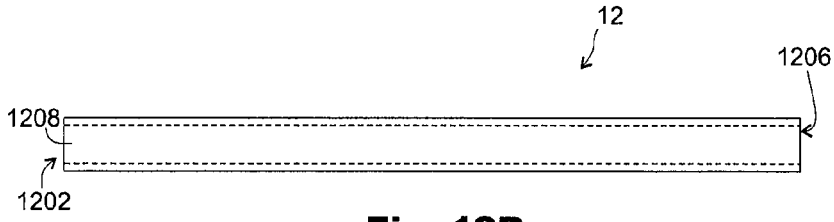

FIGS. 12A–12B illustrate an embodiment of the outer capillary tube 12, wherein the outer capillary tube 12 is essentially generally cylindrical in shape, and includes an axial tube body 1204 joining a first open end 1202 and an opposite open end 1206. The inner diameter of the outer capillary tube 12 is at least slightly larger than the outer diameter of the small inner tube 11. Preferably, the tube 12 is made from a flexible material such as HDPE, and has a nominal wall thickness of between about 0.01 to 0.03 inches.

The relative volumes of tubes 11 and 12 are important to the optimal control of ink flow in response to user squeezing pressure exerted on the reservoir body 10 when the art instrument is activated and fully assembled. In particular, the inventors have discovered that an internal volume ratio of tube 11 to tube 12 of about 3:4 provides optimum controllable flow, and further promotes self-wicking in combination with either of the valve body 3 embodiments previously described herein. In contrast, the known Art-Kure brush utilizes a nearly 1:1 volume ratio between the inner capillary tube and outer capillary tube, in combination with a slotted valve body and an ink of less than 5 cps, resulting in undesirable fast flow and spurting of ink from the bristle assembly. Furthermore, the inventors have discovered that the relative volumes of the outer tube 12 and reservoir body 10 help to optimally control ink flow. Preferably, the ratio of the volume of the reservoir body 10 to the volume of the outer tube 12 is at least about 15:1, and more preferably greater than about 18:1.

Figure 13A:
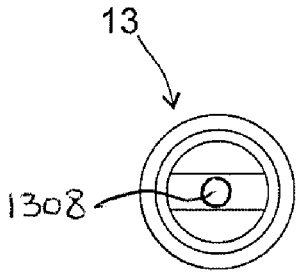
FIGS. 13A through 13B illustrate the plug for the outer capillary tube of the art instrument in accordance with one embodiment of the present invention.
Figure 13B:
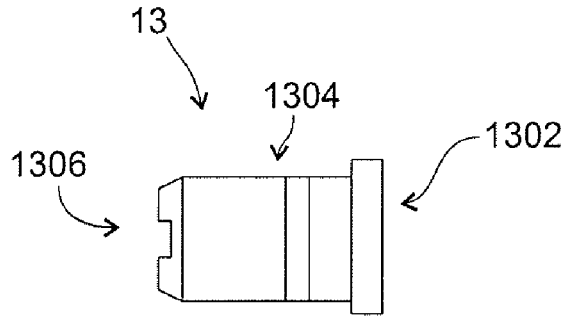

Lastly, FIGS. 13A–13B illustrate the plug 13 for insertion into the open end 1206 of the outer capillary tube 12. Notably, the plug has a first end 1302 that is of sufficient outer diameter so as to frictionally and securely fit into the open end 1206 of the outer capillary tube 12. The plug 13 is open, in other words, it includes an axial channel 1308 in the body portion 1304 that communicably connects the first end 1302 with the second end 1306. Preferably, the axial channel is open at both ends 1302, 1306 so as to allow free flow of liquid from the reservoir through the plug 13 and into the capillary tubes 12, 11. More preferably, the channel 1308 has a smaller diameter at the first end 1302 than at the second end 1306. However, the axial channel may also optionally include a valve that permits liquid to flow when pressure is exerted on the reservoir body 10, while still being "open" within the meaning of that term as used herein. Preferably, the channel at the first end 1302 further includes a slot or other fixed opening that is of smaller cross-sectional area than the channel 1308 adjacent the second end 1306. Most preferably, the first end 1302 of the plug includes a slot that permits the end 1106 of the inner tube 11 to rest against the outer wall of the end 1302 without blocking the flow of fluid from the channel 1308 and into the inner tube 11 and outer tube 12. Preferably, the plug 13 is made from a flexible material such as HDPE.

Figure 10A:
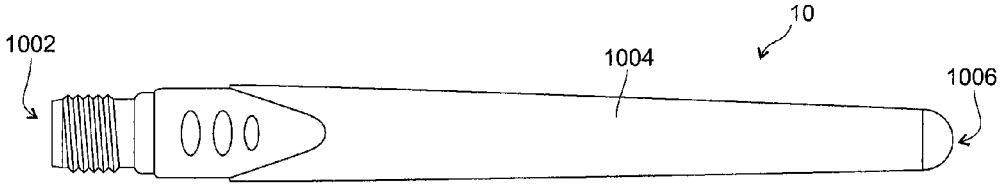
FIGS. 10A through 10B illustrate the reservoir body of the art instrument in accordance with one embodiment of the present invention.
Figure 10B:
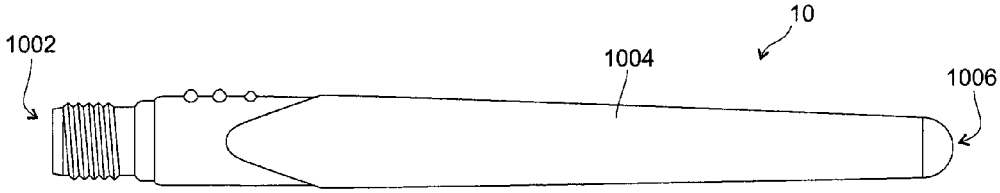

As shown in FIGS. 10A–10B, the reservoir body 10 includes a generally cylindrical body portion 1004 having a first threaded end 1002 and an opposite closed end 1006. The body 10 is of sufficient size and diameter so as to act as a storage reservoir for an amount of art liquid to permit painting without requiring frequent refills. Preferably, the reservoir holds between about 0.1 to about 2 ounces of liquid. Preferably, the body 10 is also refillable by unthreading and removing the nozzle 2 and other components to permit a user access to the open end 1002 of the reservoir body 10. To enable connection to the threaded end 306 of the nozzle 2, the threaded end 1002 should be the mate of the threaded end 306. The body 1004 should be made from a flexible material such as high-density polyethylene (HDPE), and should have wall thickness of between about 0.01 to 0.09 inches to allow for easy squeezing by a user to activate the liquid dispensing system of the paintbrush. Additionally, grip features such as texturing, ridges, grooves, and other known grip-enhancing features can be incorporated as shown in FIGS. 10A–10B.

Having recited the various components of the art instrument in a first and second embodiment, we will now explain how the components interact to commence and control liquid flow when the assembled paintbrush is activated. The initial assembly by the manufacturer includes the insertion of the end 1306 of the plug 13 into the second end 1206 of the outer capillary tube 12. Next, the inner capillary tube 11 is inserted into the open end 1202 of the outer capillary tube 12 until the end 1106 rests against the plug end 1306, with the plug end 1306 having irregular external surface geometry such as a recessed slot to ensure flow of liquid from the channel 1308 into the axial channels 1108, 1208 of the inner tube 11 and the outer tube 12. Next, the protruding end 806 of the pin 8 is inserted into open end 1102 of the inner capillary tube 11. Next, the pin-receiving end 706 of the orifice restrictor 7 is inserted over the opposite end 802 of the pin 8, with the outer diameter of the pin-receiving end 706 simultaneously fitting into the axial channel 1208 of the outer capillary tube. Next, the shipping ring 9 is placed over the threaded end 1002 of the reservoir body 10, the reservoir body 10 is filled with liquid such as watercolor paint, and the capillary tube/restrictor assembly is inserted plug-first into the reservoir body 10 until only the first end 702 of the restrictor 7 protrudes from the open end 1002 of the reservoir body 10. Optionally, the sealing means 14, preferably an O-ring, seals the restrictor 7 to the opening 1002 of body 10. This completes the first sub-assembly.

To assemble the second sub-assembly, the bristle portion 4 is inserted into the valve body 3 so that the capped end 502 securely engages the retaining tabs 412 to permit the tapered end 506 of the bristle assembly 4 to protrude from the end 402 of the nozzle 2. The primary orifice restrictor 6 is placed so that the first end 602 rests against the valve body end 410 of the valve body 3 adjacent the capped end 502 of the bristle portion. Next, the cap 1 is placed over the first end 302 of nozzle 2, and the threaded end 306 of the nozzle 2 is slid over the end 402 of the valve body 3 and bristle portion 4 assembly until the nozzle 2 and cap 1 enclose the entire valve body and bristle assembly.

Finally, the first sub-assembly and second sub-assembly are mated together to form a complete product. This assembly comprises the step of mating the threaded end 1002 of the reservoir body 10 of the first sub-assembly to the threaded end 306 of the second sub-assembly, and threading the two ends 1002, 306 together to sandwich the exposed first end 702 of the secondary orifice restrictor 7 of the first sub-assembly against the exposed protruding end 606 of the primary orifice restrictor 6. However, because of the inclusion of the shipping ring 9, at least one of the threads of the threaded end 1002 is unavailable to the threaded end of the nozzle 2. The length of the protruding end 606 is such that when at least one thread is blocked, the protruding end 606 is prevented from penetrating the axial channel 708 of the secondary restrictor to displace the end 802 of the pin 8, thereby preventing any ink flow from the pin to the axial channel 708 since the end 802 remains in tight contact with the pin-receiving end 706. Thus, no liquid can leave the inner capillary tube 11 and pin 8 while the ring 9 remains in place, such as during shipping.

Upon purchase of the product, the instrument is activated by a user. This is accomplished by disassembling the first sub-assembly from the second sub-assembly by unthreading the nozzle end 306 from the threaded end 1002. The user then removes the ring 9 from the threaded end 1002, and proceeds to re-assemble the two sub-assemblies by threading the end 306 of the nozzle 2 onto the threaded end 1002 of the reservoir body 10. With the ring 9 removed, all threads of the threaded end 1002 are available to mate with the nozzle end 306. Fully mating all threads results in compression that forces the protruding end 606 of the primary orifice restrictor fully into the axial channel 708 of the secondary orifice restrictor 7. In the preferred embodiment, the body 704 and corresponding length of the channel 708 are short enough so that the protruding end 606 of the primary restrictor presses against the first end 802 of the pin, thereby creating a space between the end 808 and the surrounding channel step 710 to permit liquid in the pin 8 to flow into the axial channel 708. The flowing ink then passes through the protruding end 606, through the channel 608 of the primary orifice restrictor, and into and/or around the capped end to reach the bristle portion 4. Once ink flow has thus commenced, a user can control the flow simply by capillary action (slowest flow), or may exert pressure such as by squeezing the reservoir body 10 to obtain faster liquid flow.

Lastly, while the embodiment described herein includes a non-resealable arrangement of the orifice restrictors 6, 7 and pin 8 due to their construction using plastics such as HDPE, it is fully contemplated and conceived by the inventors that use of more flexible and self-resilient materials, such as silicone, rubber, self-healing materials, and spring biasing of the pin 8 to a storage position, and the like, may provide for re-sealing. For example, it is fully contemplated that the pin 8 and restrictors 6, 7 can be paired with one or more spring members that would force the pin end 802 to re-engage the channel step 710 of the secondary restrictor when the shipping ring is re-inserted to block full thread mating between the nozzle end 306 and threaded end 1002. Simply said, insertion of the ring would prevent full tightening, and the spring member would not be fully compressed, and would therefore force the large diameter end 802 of the pin 8 to return to its normal position against the channel step 710, thereby blocking ink flow.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An art instrument having a self-contained reservoir for storing and dispensing ink, and an ink-dispensing assembly for distributing the ink onto a desired surface to be painted, the art instrument comprising:

a reservoir body for containing ink, the reservoir body having an open end and an opposite closed end portion, the open end having means for connecting the reservoir body to an ink dispensing assembly;

an ink-dispensing assembly communicably linking the reservoir body to a brush assembly, wherein the ink-dispensing assembly comprises:

an outer capillary tube;

an inner capillary tube nested inside the outer capillary tube;

an open plug inserted into one end of the outer capillary tube and acting as a travel stop for the inner capillary tube;

a secondary orifice restrictor that includes a tube-receiving end having a recessed stepped portion for receiving an unencumbered end of the inner capillary tube, and having a stepped outer surface with a cross-sectional diameter that permits the tube-receiving end to be inserted into the unencumbered end of the outer capillary tube, wherein the secondary orifice restrictor further includes an axial channel that protrudes along the entire axial length of the secondary restrictor;

wherein the axial channel is generally cylindrical, and includes at least one stepped portion for receiving a pin having a first large-diameter end and an opposite small-diameter end, wherein the large-diameter end is inserted into the axial channel adjacent the tube-receiving end and extends through the channel to a channel step provided adjacent the opposite end of the secondary orifice restrictor, so that the large-diameter end is substantially flush with the terminal end of the axial channel adjacent the second end of the secondary orifice restrictor;

wherein the small-diameter end of the pin protrudes into the axial channel of the inner capillary tube;

wherein the ink-dispensing assembly further includes a primary orifice restrictor having a protruding tube end, an opposite end, and an axial channel linking the two ends;

wherein the protruding tube end is configured so as to penetrate the axial channel of the secondary orifice restrictor and to displace the large-diameter end of the pin upon activation of the ink-dispensing system by a user; and a brush assembly including a bristle assembly surrounded by a valve body comprising an unvented sidewall, the valve body surrounded by a nozzle portion, the nozzle portion having a first end for connection to the open end of the reservoir body, and an opposite open end disposed adjacent the opposite end of the primary orifice restrictor so that ink flowing from the primary orifice restrictor meets the bristle assembly, and wherein the ink flows through and around the bristle assembly for distribution onto a surface to be painted.

2. The art instrument of claim 1, wherein the art instrument further comprises an ink having a viscosity of less than about 8 cps.

3. The art instrument of claim 2, wherein the ink has a viscosity of less than about 6 cps.

4. The art instrument of claim 2, wherein the ink has a viscosity of less than about 5 cps.

5. The art instrument of claim 1, wherein the internal volume ratio of the inner capillary tube to the outer capillary tube is about 3:4.

6. The art instrument of claim 5, wherein the internal volume ratio of the reservoir body to the outer capillary tube is greater than about 15:1.

7. The art instrument of claim 1, wherein the brush assembly comprises a non-porous base connecting all bristles of the brush assembly.

8. The art instrument of claim 1, wherein the brush assembly comprises a porous base of the brush assembly.

9. The art instrument of claim 1, further comprising a cap for covering the bristle assembly when the art instrument is not in use.

10. An art instrument for controllably dispensing an ink having a viscosity of less than about 8 cps, the art instrument comprising:

a reservoir body containing an ink having a viscosity of less than about 8 cps, the reservoir body having an open end and an opposite closed end portion, the open end having means for connecting the reservoir body to an ink dispensing assembly;

an ink-dispensing assembly communicably linking the reservoir body to a brush assembly, wherein the ink-dispensing assembly comprises:

an outer capillary tube;

an inner capillary tube nested inside the outer capillary tube;

an open plug inserted into one end of the outer capillary tube and acting as a travel stop for the inner capillary tube;

a secondary orifice restrictor that includes a tube-receiving end having a recessed stepped portion for receiving an unencumbered end of the inner capillary tube, and having a stepped outer surface with a cross-sectional diameter that permits the tube-receiving end to be inserted into the unencumbered end of the outer capillary tube, wherein the secondary orifice restrictor further includes an axial channel that protrudes along the entire axial length of the secondary restrictor;

wherein the axial channel is generally cylindrical, and includes at least one stepped portion for receiving a pin having a first large-diameter end and an opposite small-diameter end, wherein the large-diameter end is inserted into the axial channel adjacent the tube-receiving end and extends through the channel to a channel step provided adjacent the opposite end of the secondary orifice restrictor, so that the large-diameter end is substantially flush with the terminal end of the axial channel adjacent the second end of the secondary orifice restrictor;

wherein the small-diameter end of the pin protrudes into the axial channel of the inner capillary tube;

wherein the ink-dispensing assembly further includes a primary orifice restrictor having a protruding tube end, an opposite end, and an axial channel linking the two ends;

wherein the protruding tube end is configured so as to penetrate the axial channel of the secondary orifice restrictor and to displace the large-diameter end of the pin upon activation of the ink-dispensing system by a user; and a brush assembly including a bristle assembly surrounded by a valve body, the valve body having an unvented sidewall surrounded by a nozzle portion, the nozzle portion having a first end for connection to the open end of the reservoir body, and an opposite open end disposed adjacent the opposite end of the primary orifice restrictor so that ink flowing from the primary orifice restrictor meets the bristle assembly, and wherein the ink flows through and around the bristle assembly for distribution onto a surface to be painted.

11. The art instrument of claim 10, wherein the internal volume ratio of the inner capillary tube to the outer capillary tube is about 3:4.

12. The art instrument of claim 11, wherein the internal volume ratio of the reservoir body to the outer capillary tube is greater than about 15:1.

13. An art instrument for controllably dispensing an ink having a viscosity of greater than about 5 cps, the art instrument comprising:

a reservoir body containing an ink having a viscosity of greater than about 5 cps, the reservoir body having an open end and an opposite closed end portion, the open end having means for connecting the reservoir body to an ink dispensing assembly;

an ink-dispensing assembly communicably linking the reservoir body to a brush assembly, wherein the ink-dispensing assembly comprises:

an outer capillary tube;

an inner capillary tube nested inside the outer capillary tube;

an open plug inserted into one end of the outer capillary tube and acting as a travel stop for the inner capillary tube;

a secondary orifice restrictor that includes a tube-receiving end having a recessed stepped portion for receiving an unencumbered end of the inner capillary tube, and having a stepped outer surface with a cross-sectional diameter that permits the tube-receiving end to be inserted into the unencumbered end of the outer capillary tube, wherein the secondary orifice restrictor further includes an axial channel that protrudes along the entire axial length of the secondary restrictor;

wherein the axial channel is generally cylindrical, and includes at least one stepped portion for receiving a pin having a first large-diameter end and an opposite small-diameter end, wherein the large-diameter end is inserted into the axial channel adjacent the tube-receiving end and extends through the channel until to a channel step provided adjacent the opposite end of the secondary orifice restrictor, so that the large-diameter end is nearly flush with the terminal end of the axial channel adjacent the second end of the secondary orifice restrictor;

wherein the small-diameter end of the pin protrudes into the axial channel of the inner capillary tube;

wherein the ink-dispensing assembly further includes a primary orifice restrictor having a protruding tube end, an opposite end, and an axial channel linking the two ends;

wherein the protruding tube end is configured so as to penetrate the axial channel of the secondary orifice restrictor and to displace the large-diameter end of the pin upon activation of the ink-dispensing system by a user; and a brush assembly including a bristle assembly surrounded by a valve body, the valve body having a vented sidewall surrounded by a nozzle portion, the nozzle portion having a first end for connection to the open end of the reservoir body, and an opposite open end disposed adjacent the opposite end of the primary orifice restrictor so that ink flowing from the primary orifice restrictor meets the bristle assembly, and wherein the ink flows through and around the bristle assembly for distribution onto a surface to be painted.

14. The art instrument of claim 13, wherein the internal volume ratio of the inner capillary tube to the outer capillary tube is about 3:4.

15. The art instrument of claim 14, wherein the internal volume ratio of the reservoir body to the outer capillary tube is greater than about 15:1.

16. The art instrument of claim 13, wherein the ink has a viscosity of greater than about 10 cps.

17. The art instrument of claim 13, wherein the valve body further comprises a secondary flow regulator.

18. The art instrument of claim 10, wherein the ink has a viscosity of less than about 6 cps.

19. The art instrument of claim 10, wherein the brush assembly comprises a non-porous base connecting all bristles of the brush assembly.

20. The art instrument of claim 10, wherein the brush assembly comprises a porous base of the brush assembly.

* * * * *